United States Patent [19]

Des Voignes

[11] Patent Number: 4,463,879

[45] Date of Patent: Aug. 7, 1984

[54] ATTACK REPELLENT HOLDER

[76] Inventor: Gregory C. Des Voignes, N. 6622 Catherine, Spokane, Wash. 99208

[21] Appl. No.: 355,672

[22] Filed: Mar. 8, 1982

[51] Int. Cl.[3] ..... B65D 83/14

[52] U.S. Cl. ..... 222/175; 224/217

[58] Field of Search ..... 222/175, 183; 273/84 R; 224/217, 218; 294/149–151; 16/110 R

[56] References Cited

U.S. PATENT DOCUMENTS 3,385,601 5/1968 Black ..... 273/84 R

*Primary Examiner*—Stanley H. Tollberg

*Attorney, Agent, or Firm*—Wells, St. John & Roberts

[57] ABSTRACT

A device for holding attack repellent such as tear gas or an audible alarm securely to the hand of the wearer regardless of the open or closed condition of the hand. The device includes an elastic strap that secures the repellent to the hand with the repellent actuator accessible by the thumb or other fingers.

18 Claims, 5 Drawing Figures

ATTACK REPELLENT HOLDER

FIELD OF THE INVENTION

The present invention relates to the field of attack repelling defensive apparatus and more particularly to such apparatus that is hand held for the purpose of directing a repellent spray or for producing an audible alarm.

BACKGROUND OF THE INVENTION

The use of small pressurized hand held cannisters containing pressurized air for driving an audible alarm, or other gas such as tear gas for producing an incapacitating affect on an attacker, is rapidly gaining popularity. Use of such hand held apparatus requires that the user have adequate time in which the device can be effectively used prior to or during an attack. If the device is not easily accessible, chances are very good that the attack would be completed without the repelling device being used. In fact, there have been reported cases where the repellent device has been removed from the victim by the attacker and used against the victim. It becomes readily apparent then that there is a need to have an attack repellent device within easy access or better still, have the device always ready for use.

Keychain holders are now available for small hand held tear gas dispensers or audio "shriek" alarms. The theory is that the repellent will be readily available whenever the keys are carried. This arrangement does have the appearance of effectiveness, since many attacks occur while the victim is walking to or from his or her vehicle or residence. The difficulty, however, is that attacks are often so sudden and so vicious that the keys and attached repellent are knocked from the hand. If the victim is holding keys rather than the repellent device at the time of the attack, both hands would probably be required to change grip from the keys to the repellent device. It is highly unlikely that the attacker would allow the victim such free use of the hands. In fact, the victim's hands, especially in cases of rape, are most usually pinned to the ground or otherwise held immobile. The change of grip in such situations often becomes impossible.

The crimes of molestation, assault and rape are often directed at joggers who, are provided as easy targets partly because it is almost impossible to carry any form of defensive device while jogging. Joggers have attempted to carry repellent devices either on chains worn around the neck or tucked into waistbands. Hand carrying the devices is not practical since the hands need to be free and quickly become sweaty, reducing their grip.

The present invention enables attack repellent devices to be secured and carried in the user's hand for immediate access and use. The repellent device, since it is attached to the hand, cannot easily be dropped or even pried from the hand. The invention also permits use of the repellent even if both hands are pinned to the ground. The victim need only have use of his or her fingers (including the thumb) of the hand carrying the device. The device can be armed, pointed, and actuated with the carrying arm pinned.

The present holder is also versatile in that it can be used with a wide variety of repellent devices, from tear gas dispensers to compressed air operated whistles, sirens, and other audible alarms.

The present holder can be used at any time. It can be carried inconspicuously while jogging or walking. The device can also be carried while riding a bicycle or motorcycle, or while driving an automobile with only slight alteration of the position of the carrier and device on the wearer's hand.

No special effort is required to hold the repellent device in place since the holder is attached to the wearer's hand. The holder may also allow operation of the device with the hand open.

DETAILED DESCRIPTION

Figure 1:
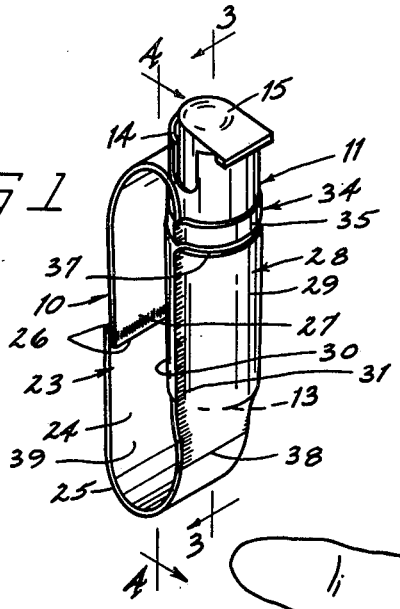
FIG. 1 is a pictorial view of a holder showing principal elements of the present invention.

A holder illustrating the principal elements of the present invention is indicated in the drawing by the reference numeral 10. It is the purpose of the present holder 10 to secure a hand held attack repellent device 11 to the hand 17 of the user. The holder 10 thereby secures the repellent device 11 for instant access and actuation by the user regardless of the position of the hand or arm and whether or not the hand can close over the repellent device.

It should be pointed out that the present invention can be manufactured and marketed with or without the attack repellent device 11 in place. The holder 10 is easily adapted to receive several different forms of attack repellent devices 11 such as tear gas or "mace" cannisters, or audible "shriek" alarms. Several sizes of the repellent can be accommodated.

The attack repellent device 11 includes an elongated cylindrical body 12. The body 12 is typically a pressurized container including a repellent chemical, or pressurized air in the case of audible alarms.

The cylindrical body 12 extends from a base end 13 to an actuator end 14. An actuator cap 15 is at the actuator end 14 for manual operation by the user. There are many different containers and contents. The actuator caps are fairly typical.

The cap 15 is rotatably mounted to the cylindrical body 12 and includes a push button dispensing nozzle 16.

The nozzle 16 is fitted to the cap 15 and is rotatable thereon between a "safe" position as shown in FIG. 1 where the button cannot be pressed, and an "armed" position (FIG. 2) where the button 16 is rotated about 90° and may be pressed to discharge the compressed air or chemical.

Typically, the attack repellent device 11 is held in the palm or within the "palmer surface" 19 of the hand with the fingers closed over the cylindrical body 12. The cap 15 then extends upwardly of the closed fist for access by the thumb. Other positions might also be used to allow operation of the repellent by the index finger of the same hand.

The present holder 10 includes a securing means generally shown at 23 for positioning the attach repellent 11 securely on the user's hand. Specifically, the securing means is adapted to secure the attack repellent with the cylindrical body 12 extending across the hand.

Figure 2:
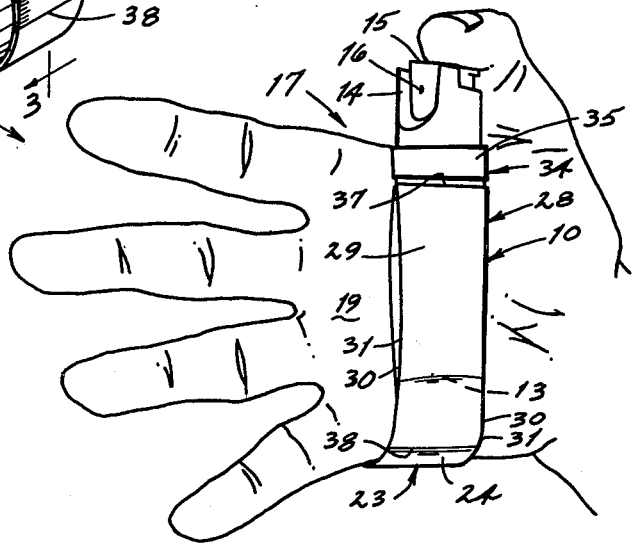
FIG. 2 is a pictorial view of the present holder mounted to a user's hand.

FIG. 2 shows the securing means 23 holding the repellent device 11 in a transverse orientation across the palmar surface of the wearer's hand. This position is preferred by many who wish to carry the repellent for operation by the thumb.

The transverse orientation can also be achieved by mounting the strap across the fingers (rather than the palm) so the cylindrical body transversely spans the hand across the back or "dorsal" side of the hand, between the knuckles and second finger joints. The thumb may still be used to operate an attack repellent device held in this position, while the inside or palmar surface of the hand can be used for other purposes, such as holding a steering wheel or bicycle handlebar.

The securing means 23 is preferably comprised of an elongated elastic band 24 adapted to be fitted over the hand in an orientation laterally spanning both the "palmar" and "dorsal" surfaces adjacent the knuckles.

The elastic band 24 includes substantially parallel longitudinal side edges 25. The edges 25 are spaced apart by overlapping ends 26. The ends 26 are secured together to form a closed loop by stitching 27. It is noted that other fastening media may also be used, such as glue, staples or rivets.

The size of the loop created by band 24 is smaller than the average hand in order to stretch and firmly grip the hand when the band is slipped into place. Several sizes of the strap can be produced and marketed. Also, it is possible that an adjustable fastening mechanism such as "Velcro", buckles, etc. may be provided to adjustably and releasably secure the overlapping ends 26 together. A single band 24 could then fit many hand sizes.

The securing means 23 is adapted to hold the cylindrical body 12 of the attack repellent across the palm of the hand with the actuator end 14 protruding clear of the securing means 23 and a pocket means 28. The actuator end is therefore brought into easy access by the thumb as shown in FIG. 2.

The pocket means 28 is provided on the securing means 23. The pocket means 28 is comprised of a pocket cover 29 that may be constructed of an elastic material similar to that of band 24. The cover 29 includes longitudinal side edges 30 that may be fixed to the band 24 by stitching 31. Again, other forms of attachment may be used to secure the band and pocket cover together.

The side edges 30 are attached to the band side edges 25 so that an open top end 37 is formed at a top section of the pocket and a similar open end 38 is found at the bottom end 37. This allows access to the attack repellent devices 11 through the open top end. It also allows mounting of a longer device 11, since the open bottom end 38 will allow the bottom end of the cylindrical body to project down beyond the bottom end of the cover.

Figure 3:
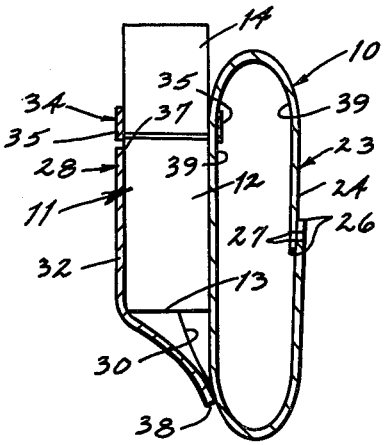
FIG. 3 is a sectional view taken substantially along line 3—3 in FIG. 1; without the repellent device being shown in section.
Figure 4:
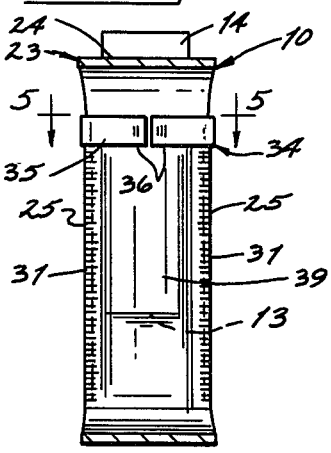
FIG. 4 is a sectional view taken substantially along line 4—4 in FIG. 1.

The material of the pocket cover 29 preferably includes an elastic fabric or other means by which the attack repellent device 11 can be gripped and held securely against the wearer's hand and for resisting axial movement of the cylindrical body within the pocket means. The gripping means is preferably integral with the cover 29 and formed of the same elastic material that is used in the elastic band 24. In fact, opposed side surfaces of the pocket as shown in FIG. 3 are formed respectively of the pocket cover 29 and part of the band 24. Both serve to grip the cylindrical body 12.

A secondary gripping means 34 is provided adjacent the pocket means 28 on securing means 23. The secondary gripping means is provided to receive and secure the actuator cap 15 against rotation relative to the remainder of the cylindrical body 12 and to the holder 10. The cap is therefore held in a position selected by the user and will stay in that position unless otherwise forcibly moved. The actuator cap 15 can therefore be "aimed" in, say, the same direction as the pointed index finger. The user can then operate the repellent, knowing that it will discharge in the same direction as the pointed index finger.

The secondary gripping means 34 is comprised of an elastic strap 35 formed in a closed loop and affixed to the hand 24 of the securing means 23. The looped strap 35 is situated adjacent the pocket at its open top end 37.

Figure 5:
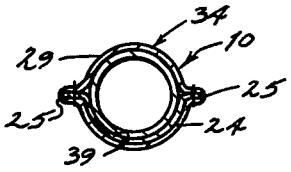
FIG. 5 is a sectional view taken substantially along line 5—5 in FIG. 4.

The strap 35 includes ends 36 that overlap an adjacent section of the band 24. It is preferred that the ends wrap about the band 24 along an inside surface 39 thereof. As shown in FIGS. 3 and 5, only a portion of the strap 35 engages the actuator cap 15. The remainder of the cap 15 is secured by part of the band 24 that is held on the inside surface 39 by the strap ends 36.

When the holder is mounted to a hand, tension from the band 24 produces additional tension on the strap 35 and more firmly secures the actuator cap 15 in its selected position. Also, any forces applied to tear the repellent away from the band or gripping means 34 would be met with combined resistance of the band 24, pocket cover 29, and the strap 35, rather than the relatively confined areas at which the cover and strap are joined to the band.

An attack repellent device 11 is mounted to the present holder 10 simply by inserting the base end 13 through the secondary gripping means 34 and top opening 37 of pocket means 28. The device is moved axially into the pocket until the actuator cap 15 comes into engagement with the strap 35. This leaves the actuator end projecting upwardly clear of the strap 35 and band 24 substantially as shown in FIG. 1. The holder may then be placed over the user's hand as shown in FIG. 2. Here, the band 24 has been slid over the band with the repellent device 11 situated on the palmar side and with the actuator button 16 situated for easy access by the thumb. At this point, the operator can forcibly adjust the discharge for the spray or alarm so the button can be easily rotated to the "ready to spray" position and pressed to discharge in a selected direction.

The holder as mounted as described above can be carried easily and yet remain ready for operation at all times.

As briefly mentioned above, the holder 10 can be secured in other positions on the user's hand and yet still substantially transversely span the hand and present the actuator cap 15 for free access to the thumb or forefinger. In fact, the holder can be mounted so the repellent 11 is situated substantially across the knuckles on the dorsal side of the hand. The thumb can still be used in this situation to press the actuator buttons 16 simply by reaching across the folded fist. It may also be of some benefit in this situation to use the little finger of the same hand to secure the base end 13 against axial movement when the button is depressed.

It is understood that the holder will secure the attack repellent device 11 to the user's hand so the device 11 cannot be easily knocked from the hand or made inaccessible during an assault. Additionally, the unique features of the present holder enable its potential use even with the wearer's hand or arm "pinned" to the ground or to his or her sides. All that is needed is free movement of the wrist and thumb (or other "actuating finger"). The wrist movement is required to "aim" the repellent device, and the thumb (or other actuating finger) is required to arm and discharge the device.

I claim:

1. A holder for a hand held attack repellent device of the type including an elongated substantially cylindrical body extending from a base end to a manually operable actuator end and adapted to be held in the palm of a hand, said holder comprising:

securing means comprised of an elongated elastic band to be fitted over the hand in an orientation laterally spanning the palmar and dorsal surfaces thereof adjacent the knuckles to securely grip the hand;

pocket means on the securing means adapted to hold the substantially cylindrical body of the attack repellent device across the hand with the actuator end of the device protruding clear of the securing means, and accessible by one of the fingers of the same hand, such as the thumb; and wherein the pocket means includes means adapted to grip the substantially cylindrical body of the repellent device to hold it securely against the wearer's hand and to resist axial movement of the body within the pocket means.

2. A holder as claimed by claim 1 for attack repellent devices having a rotatable actuator cap at the actuator end of the substantially cylindrical body, and further comprising:

secondary gripping means on the securing means adjacent the pocket means, adapted to receive and secure the actuator cap of the attack repellent device against rotation relative to the holder.

3. The holder as claimed by claim 1 wherein the pocket means includes an elongated flexible cover having longitudinal side edges attached to the band and having a top end and a bottom end spaced apart by the side edges, the top edge defining an opening for receiving a repellent device.

4. The holder as claimed by claim 3 wherein the gripping means is comprised of elastic fibers within the flexible cover.

5. The holder as claimed by claim 3 wherein the bottom end of the flexible cover defines an opening.

6. A holder as claimed by claim 3 for attack repellent devices having a rotatable actuator cap at the actuator end of the substantially cylindrical body, and further comprising:

secondary gripping means on the securing means adjacent the pocket means, adapted to receive and secure the actuator cap of an attack repellent device against rotation relative to the holder.

7. The holder as claimed by claim 6 wherein the secondary gripping means is comprised of an elastic strap formed in a closed loop and affixed to the securing means adjacent the pocket means.

8. A hand held attack repellent apparatus, comprising:

a substantially cylindrical body having a base end and an actuator end;

an actuator cap at the actuator end, manually operable to issue an attack repellent media upon manual actuation thereof;

an elastic securing band for extending about and securely gripping a hand laterally of the fingers;

an elastic pocket cover having elongated side edges attached to the band, forming an elastic pocket releasably receiving and gripping the cylindrical body.

9. An attack repellent apparatus as claimed by claim 8 wherein the actuator cap is rotatable at the actuator end of the substantially cylindrical body, and further comprising:

secondary gripping means on the securing means adjacent the pocket to receive and secure the actuator cap against rotation relative to the securing band.

10. The apparatus as claimed by claim 8 wherein the elastic pocket cover includes longitudinal side edges attached to the securing band and having a top end and a bottom end spaced apart by the side edges, the top edge defining an opening for receiving the cylindrical body.

11. The apparatus as claimed by claim 10 wherein the bottom end of the flexible cover defines an opening.

12. The apparatus as claimed by claim 10 wherein the actuator cap is rotatable at the actuator end of the substantially cylindrical body, and further comprising:

secondary gripping means on the securing band adjacent the pocket means, adapted to receive and secure the actuator cap against rotation relative to the elastic securing band.

13. The apparatus as claimed by claim 12 wherein the secondary gripping means is comprised of an elastic strap formed in a closed loop and affixed to the securing band adjacent the elastic pocket cover.

14. A holder for a hand held attack repellent device of the type including an elongated substantially cylindrical body extending from a base end to a manually operable actuator end and adapted to be held in the palm of a hand, said holder comprising:

elastic securing means to be mounted securely about the hand transversely gripping and releasably encompassing the dorsal and palmar surfaces thereof;

elastic pocket means on the securing means securing the substantially cylindrical body of the attack repellent device to the securing means across the hand with the actuator end of the device protruding from the hand clear of the securing means, and directly accessible by one of the fingers of the same hand, such as the thumb.

15. A holder as claimed by claim 14 for a hand held attack repellent device having a rotatable actuator cap at the actuator end of the substantially cylindrical body, and further comprising:

secondary gripping means on the elastic securing means adjacent the pocket means, adapted to receive and secure the actuator cap of the attack repellent device against rotation relative to the holder.

16. The holder as claimed by claim 14 wherein the elastic securing means is comprised of an elongated elastic band formed in a loop to be fitted over the hand in an orientation laterally spanning the palmar and dorsal surfaces thereof adjacent the knuckles.

17. The holder as claimed by claim 14 wherein the pocket means includes an elongated flexible cover having longitudinal side edges attached to the securing means and having a top end and a bottom end spaced apart by the side edges, the top edge defining an opening for receiving a repellent device.

18. The holder as claimed by claim 15 wherein the secondary gripping means is comprised of an elastic strap formed in a closed loop and affixed to the securing means adjacent the pocket means.

* * * * *